US008042236B2

(12) United States Patent
Lin

(10) Patent No.: US 8,042,236 B2
(45) Date of Patent: Oct. 25, 2011

(54) PLUG PIN, A POSITION PIN, AND A PLUG PIN SET OF A ZIPPER

(75) Inventor: Yu-Pau Lin, Pingjhen (TW)

(73) Assignee: Chung Chwan Enterprise Co., Ltd., Tao Yuan Hsien (TW)

( * ) Notice: Subject to any disclaimer, the term of this patent is extended or adjusted under 35 U.S.C. 154(b) by 246 days.

(21) Appl. No.: 12/469,933

(22) Filed: May 21, 2009

(65) Prior Publication Data

US 2010/0293760 A1 Nov. 25, 2010

(51) Int. Cl.
*A44B 19/36* (2006.01)
*A44B 19/38* (2006.01)

(52) U.S. Cl. ..... 24/434; 24/415; 24/433

(58) Field of Classification Search ..... 24/415, 24/433, 434

See application file for complete search history.

(56) References Cited

U.S. PATENT DOCUMENTS

| | | | | |
|---|---|---|---|---|
| 6,775,885 | B1 * | 8/2004 | Wang | 24/385 |
| 2006/0282998 | A1 * | 12/2006 | Kusayama et al. | 24/434 |
| 2010/0299887 | A1 * | 12/2010 | Lin | 24/433 |

* cited by examiner

*Primary Examiner* — Robert Sandy
*Assistant Examiner* — Louis Mercado
(74) *Attorney, Agent, or Firm* — Muncy, Geissler, Olds & Lowe, PLLC

(57) ABSTRACT

A plug pin of a zipper has a plug pin body. The plug pin body has a first long side and a second long side. The first long side and the second long side are located on two opposite sides of the plug pin body. In the plug pin body, there is a first joint trough. On the first long side, there is a first concave trough. By utilizing the first concave trough, the extruded and protruded effect when the plug pin is fastened onto the zipper belt can be cancelled so that the plug can be plugged and lifted smoothly. A position pin and a plug pin set of a zipper are also disclosed.

14 Claims, 8 Drawing Sheets

PLUG PIN, A POSITION PIN, AND A PLUG PIN SET OF A ZIPPER

BACKGROUND OF THE INVENTION

1. Field of the Invention

The present invention relates to a plug pin, a position pin, and a plug pin set of a zipper; in particular, the present invention relates to a plug pin, a position pin, and a plug pin set of a double opening zipper that allows the plug pin and the position pin to be plugged and lifted smoothly.

2. Description of Related Art

Zippers are popularly applied to leather bags and clothing and can be easily operated. The principle of zippers is in that two zipper belts can be toothed to each other, and the two zipper belts are controlled to be opened or closed by pulling the zipper head back and forth. The material of the zipper belt and the zipper head can be metal, nylon, or plastic steel, etc.

Reference is made to FIGS. 1 and 2, which show the double opening zipper of the prior art. On the first zipper belt 10*a* and the second zipper belt 11*a*, there is a first zipper head 12*a* and a second zipper head 13*a* so that both ends of the first zipper belt 10*a* and the second zipper belt 11*a* can be controlled to be opened and closed. One end of the first zipper belt 10*a* and the second zipper belt 11*a* respectively has a position pin 14*a* and a plug pin 15*a*.

The first zipper head 12*a* and the second zipper head 13*a* can be assembled on the first zipper belt 10*a* in advance, and the two zipper heads 12*a* and 13*a* are blocked and positioned by the position pin 14*a* located at one end of the first zipper belt 10*a* (as shown in FIG. 1). Next, the plug pin 15*a* located at one end of the second zipper belt 11*a* passes through the sliding trough in the first zipper head 12*a* and is plugged into the sliding trough in the second zipper head 13*a* (as shown in FIG. 2). Thereby, the first zipper head 12*a* and the second zipper head 13*a* are assembled on the first zipper belt 10*a* and the second zipper belt 11*a*, so thereby the first zipper belt 10*a* and the second zipper belt 11*a* may be toothed to each other can then be closed and opened by pulling the first zipper head 12*a* and the second zipper head 13*a* back and forth.

However, the position pin 14*a* and the plug pin 15*a* are fastened on the first zipper belt 10*a* and the second zipper belt 11*a* by punching the fastening point. The fastening point are punched and formed on one side or two sides of the position pin 14*a* and the plug pin 15*a* so that one side of the position pin 14*a* and the plug pin 15*a* that are adjacent to each other is extruded and protruded due to punching. The protruded may interfere with the first zipper head 12*a* and the second zipper head 13*a* so that the position pin 14*a* and the plug pin 15*a* cannot be smoothly plugged and lifted.

SUMMARY OF THE INVENTION

One particular aspect of the present invention is to provide a plug pin, a position pin, a plug pin set of a zipper. When the plug pin and the position pin are punched and fastened on the zipper belt, one side of the plug pin and the position pin does not extrude nor protrude so that the position pin 14*a* and the plug pin 15*a* can be plugged and lifted smoothly.

The plug pin of a zipper has a plug pin body. The plug pin body has a first long side and a second long side. The first long side and the second long side are located on two opposite sides of the plug pin body. In the plug pin body, there is a first joint trough. On the first long side, there is a first concave trough.

The present invention also provides a position pin of a zipper. The position pin has a position pin body. The position pin body has a third long side and a fourth long side. The third long side and the fourth long side are located on two opposite sides of the position pin body. In the position pin body, there is a second joint trough. On the third long side, there is a second concave trough.

The present invention also provides a plug pin set of a zipper. The plug pin set includes a plug pin having a plug pin body, a position pin having a position pin body. The plug pin body has a first long side and a second long side. The first long side and the second long side are located on two opposite sides of the plug pin body. In the plug pin body, there is a first joint trough. On the first long side, there is a first concave trough. The position pin body has a third long side and a fourth long side. The third long side and the fourth long side are located on two opposite sides of the position pin body. In the position pin body, there is a second joint trough. On the third long side, there is a second concave trough. The plug pin is located at one end of a zipper belt. The position pin is located at one end of another zipper belt. The plug pin is correspondingly located with the position pin.

The present invention has the following characteristics. When the plug pin and the position pin of the present invention are fastened onto the zipper belt by using a way of punching the fastening point, then the first concave trough and the second concave trough may be used for eliminating the side effect of the position pin and the plug pin becoming extruded and protruded due to punching. Thereby, one side that the plug pin and the position pin are adjacent to each other can be kept in a plane so as to prevent the interference between the plug pin, the position pin, and the zipper head from occurring. The plug pin and the position pin can be plugged and lifted smoothly.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1:
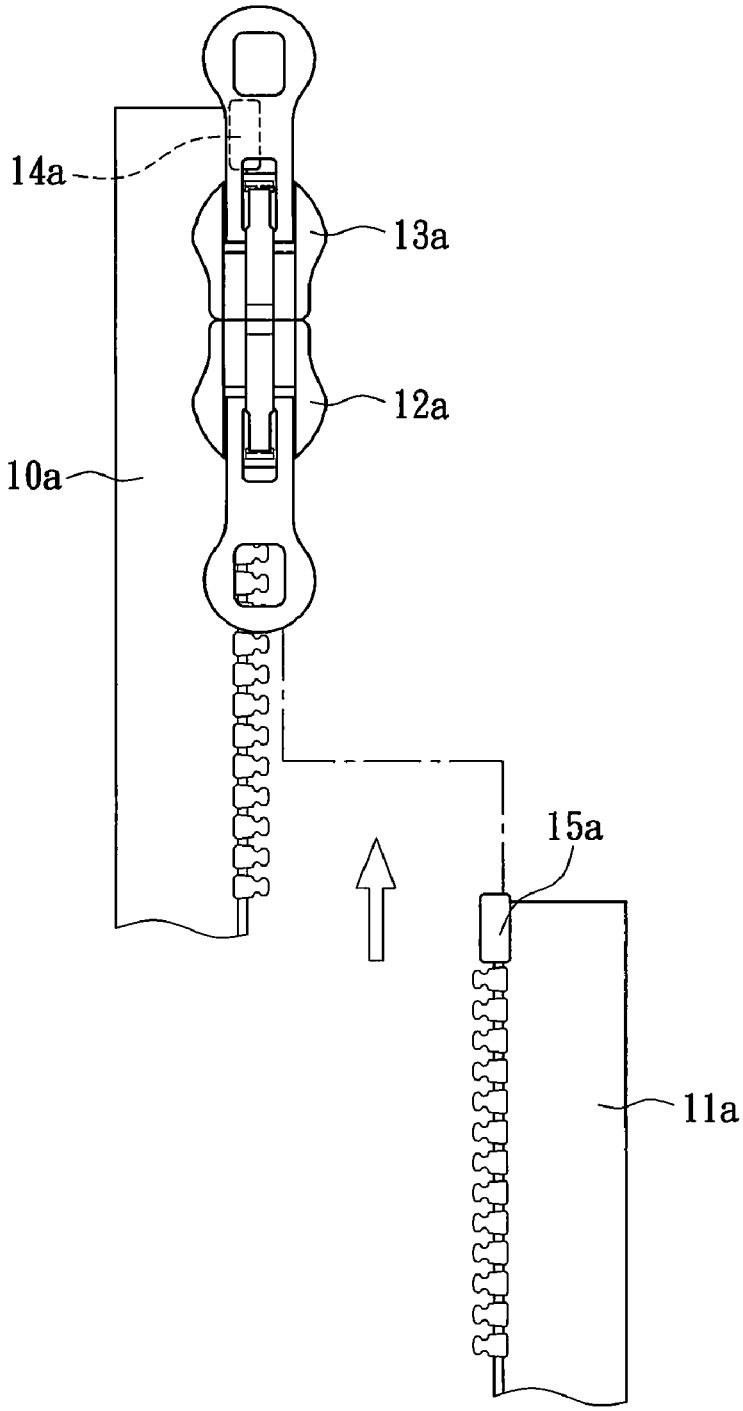
FIG. 1 is a schematic diagram of a double open zipper of the prior art.
Figure 2:
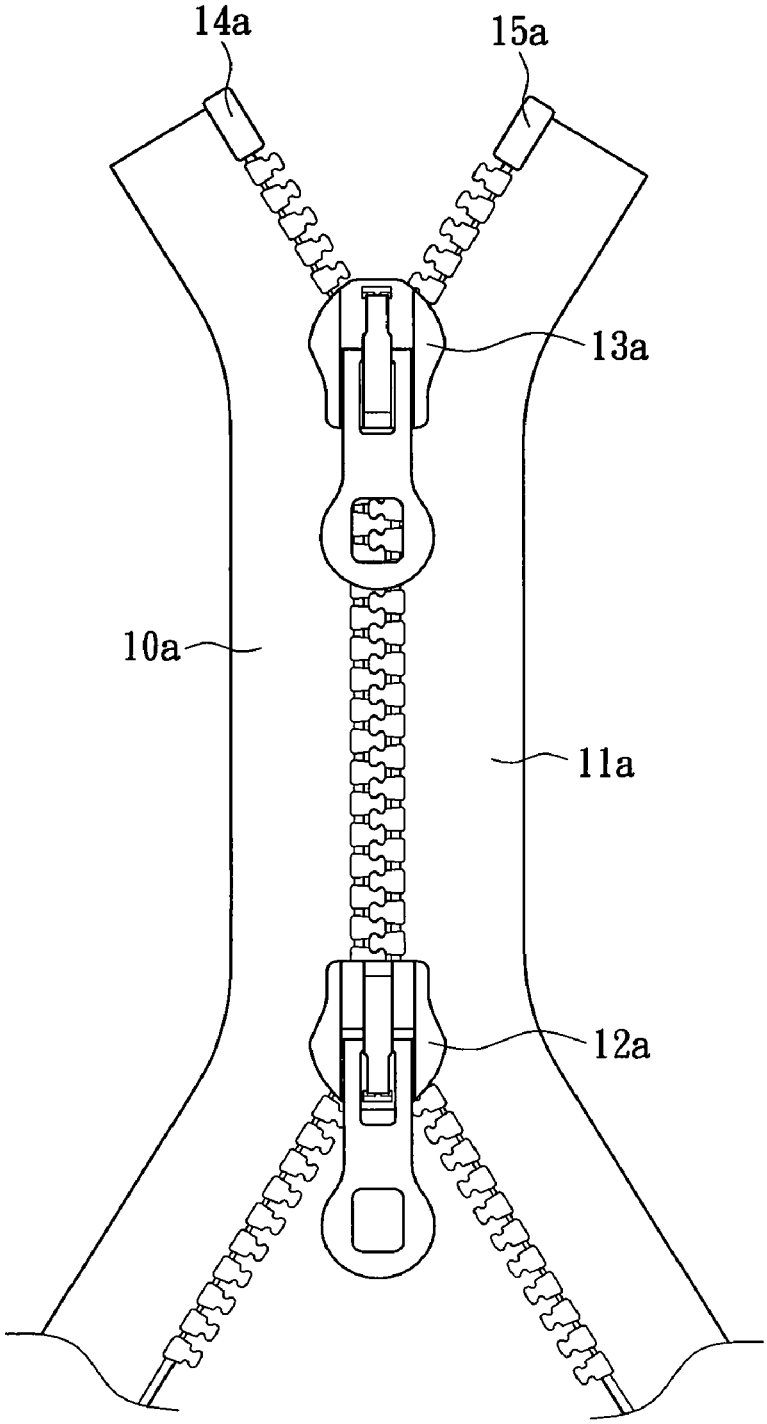
FIG. 2 PRIOR ART
FIG. 2 is another schematic diagram of the double open zipper of the prior art.
Figure 3:
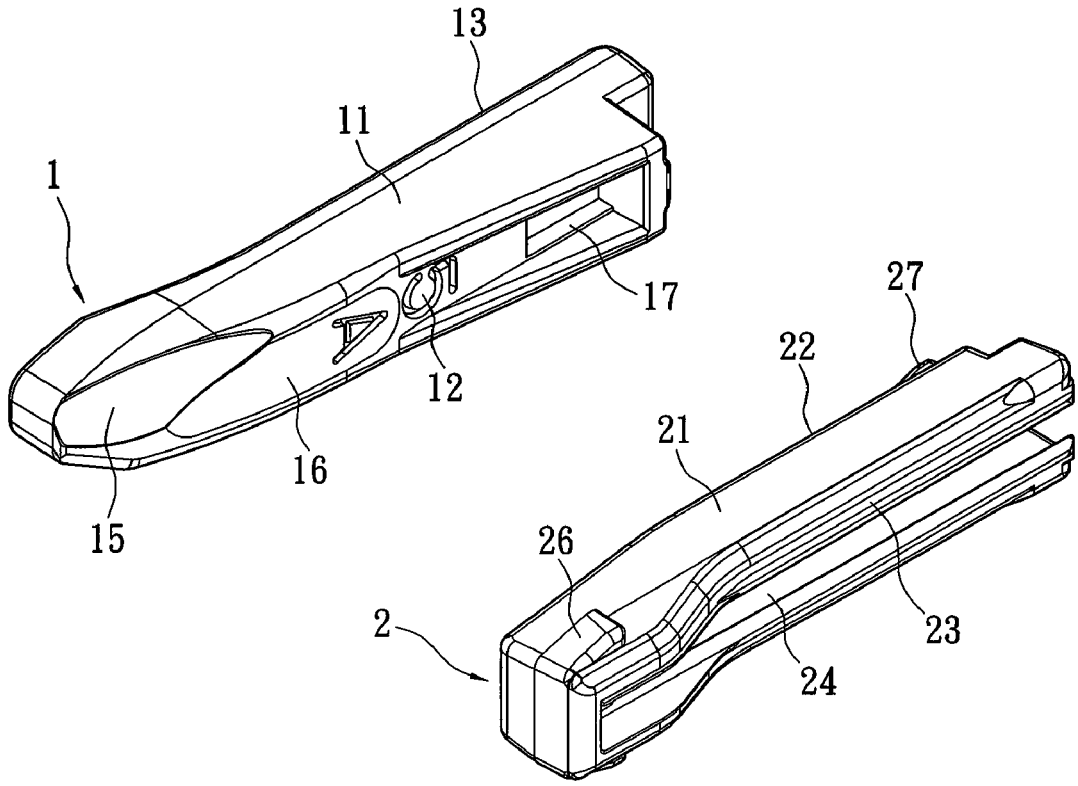
FIG. 3 is a perspective view of a plug pin set of the present invention.
Figure 4:
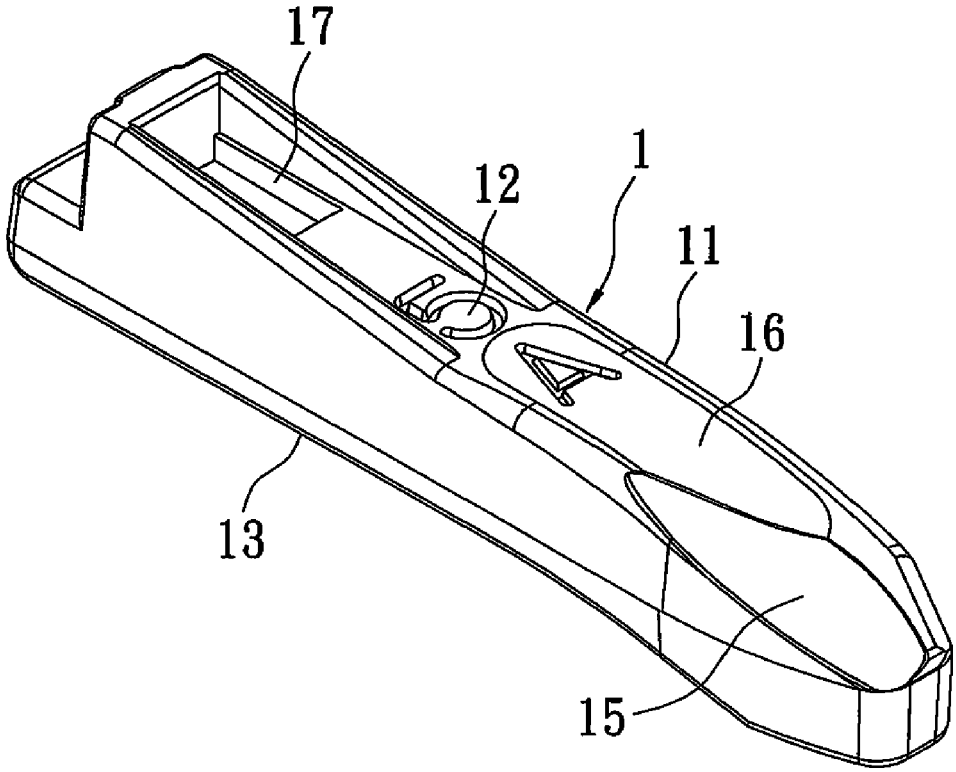
FIG. 4 is a perspective view of a plug pin of the present invention.
Figure 5:
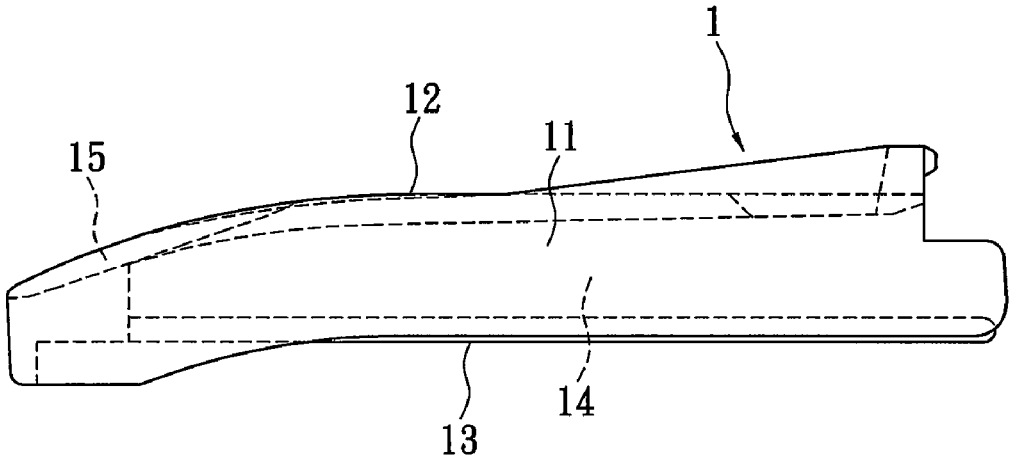
FIG. 5 is a front view of the plug pin of the present invention.
Figure 6:
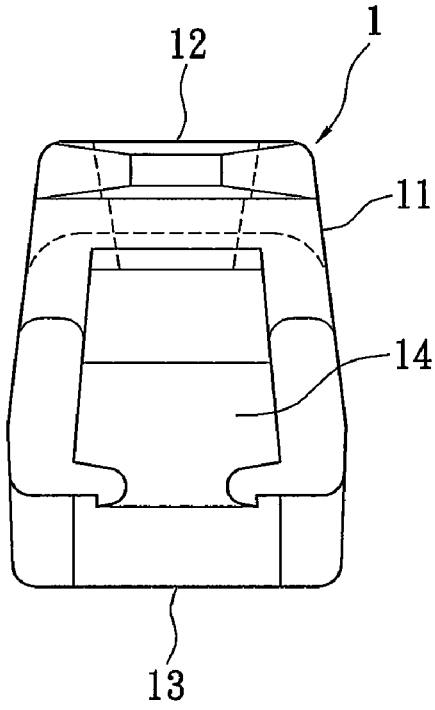
FIG. 6 is a side view of the plug pin of the present invention.

Reference is made to FIGS. 3-9, which show the plug pin set of a zipper of the present invention. The plug pin set is applied to a metallic double open zipper. The plug pin set includes a plug pin 1 and a position pin 2. The shape of the plug pin 1 and the shape of the position pin 2 are complementary and substantially symmetric. The plug pin 1 may be made of metal material. The plug pin 1 has a plug pin body 11 (as shown in FIGS. 4-6). The plug pin body 11 is substantially rectangular in shape. The shape of the front end of the plug pin body 11 resembles an arc. The rear side of the plug pin body 11 has a ladder structure. The plug pin body 11 has an upper long surface 12 (hereinafter referred to as the first long side 12) and a lower long surface 13 (hereinafter referred to as the second long side 13). The first long side 12 and the second long side 13 are located on the two opposite sides of the plug pin body 11. The plug pin body 11 further has two lateral surfaces respectively joining the first and the second long sides 12, 13. Moreover, a first joint trough 14 is arranged in the plug pin body 11 on the lower long surface13,. The first joint trough 14 passes through the second long side 13 and the rear side of the plug pin body 11. One end of the second zipper belt 4 is placed into the first joint trough 14 via the rear side of the plug pin body 11 so that the plug pin 1 is joined with one end of the second zipper belt 4.

On the first long side 12, there is a slanted surface 15 and a first concave trough 16. The slanted surface 15 is adjacent to the front end of the plug pin body 11. The slanted surface 15 extends to another side of the plug pin body 11. Having the slanted surface 15 means that the dimension of the front side of the plug pin body 11 becomes increasingly narrower. The first concave trough 16 is located at the center of the plug pin body 11. The first concave trough 16 is located at the first long side 12 with a limited depth. The dimension of the first concave trough 16 is determined by the punching force and the location of the fastening point 18. On the first long side 12, there is an embedded trough 17. The embedded trough 17 is adjacent to the rear side of the plug pin body 11.

Figure 7:
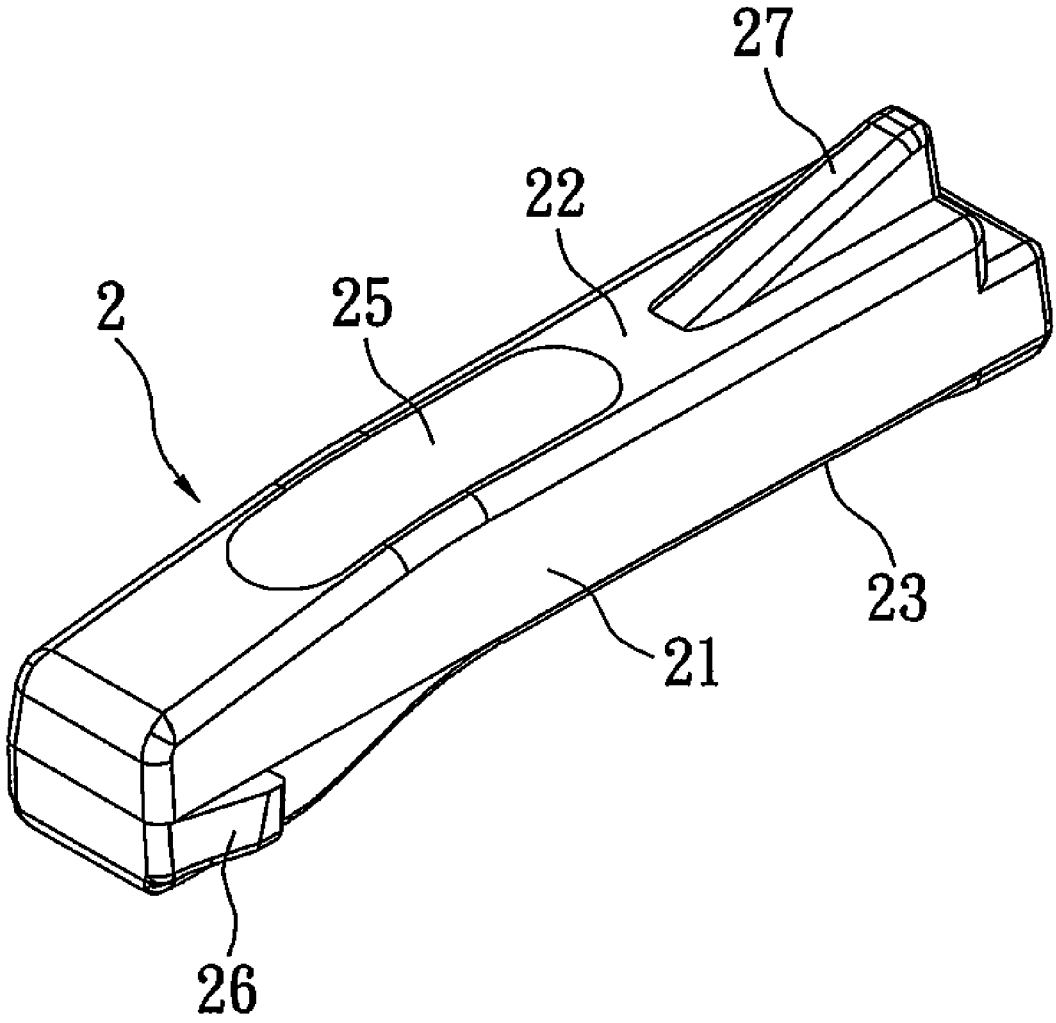
FIG. 7 is a perspective view of a position pin of the present invention.
Figure 8:
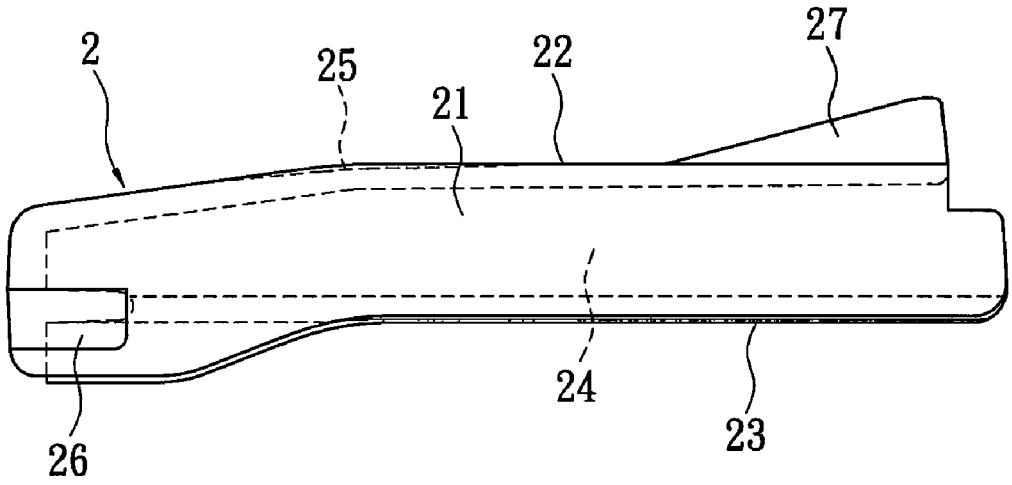
FIG. 8 is a front view of the position pin of the present invention.
Figure 9:
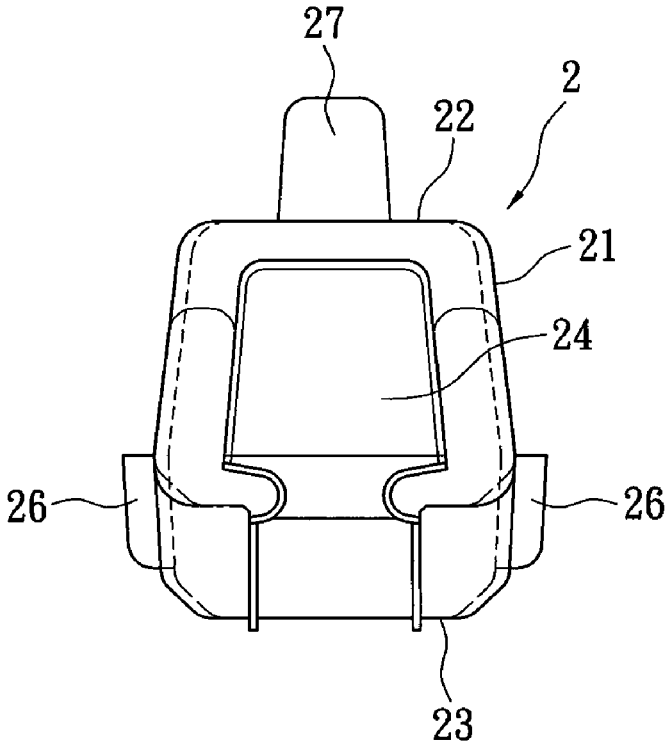
FIG. 9 is a side view of the position pin of the present invention.

The position pin 2 is a metal piece that is made of metal material. The position pin 2 has a position pin body 21 (as shown in FIGS. 7-9). The position pin body 21 is rectangular. The front end of the position pin body 21 is an arc. The rear end of the position pin body 21 is laddershaped. The position pin body 21 has an upper long surface 22 (hereinafter referred to as the third long side 22) and a lower long surface 23 (hereinafter referred to as the fourth long side 23). The position pin body 21 further has two lateral surfaces respectively joining the third and fourth long sides 22, 23. The third long side 22 and the fourth long side 23 are located at two opposite sides of the position pin body 21. In the position pin body 21, there is a long second joint trough 24. The second joint trough 24 passes through the fourth long side 23 and the rear side of the position pin body 21. One end of the first zipper belt 3 can be placed into the second joint trough 24 via the rear side of the position pin body 21 so that the position pin 2 is joined with one end of the first zipper belt 3.

On the third long side 22, there is a second concave trough 25. The second concave trough 25 is located at the center of the position pin body 21. The second concave trough 25 is located at the third long side 22 with a limited depth. The dimension of the second concave trough 25 is determined by the punching force and the location of the fastening point. Another two opposite sides of the position pin body 21 respectively have a blocking point 26. The two blocking points 26 are adjacent to the front side of the position pin body 21 for blocking the convex portion in the zipper head 6 so as to stop the zipper head. The third long side 22 further has a convex block 27. The convex block 27 is adjacent to the rear side of the position pin body 21. The convex block 27 corresponds to the embedded trough 17.

Figure 10:
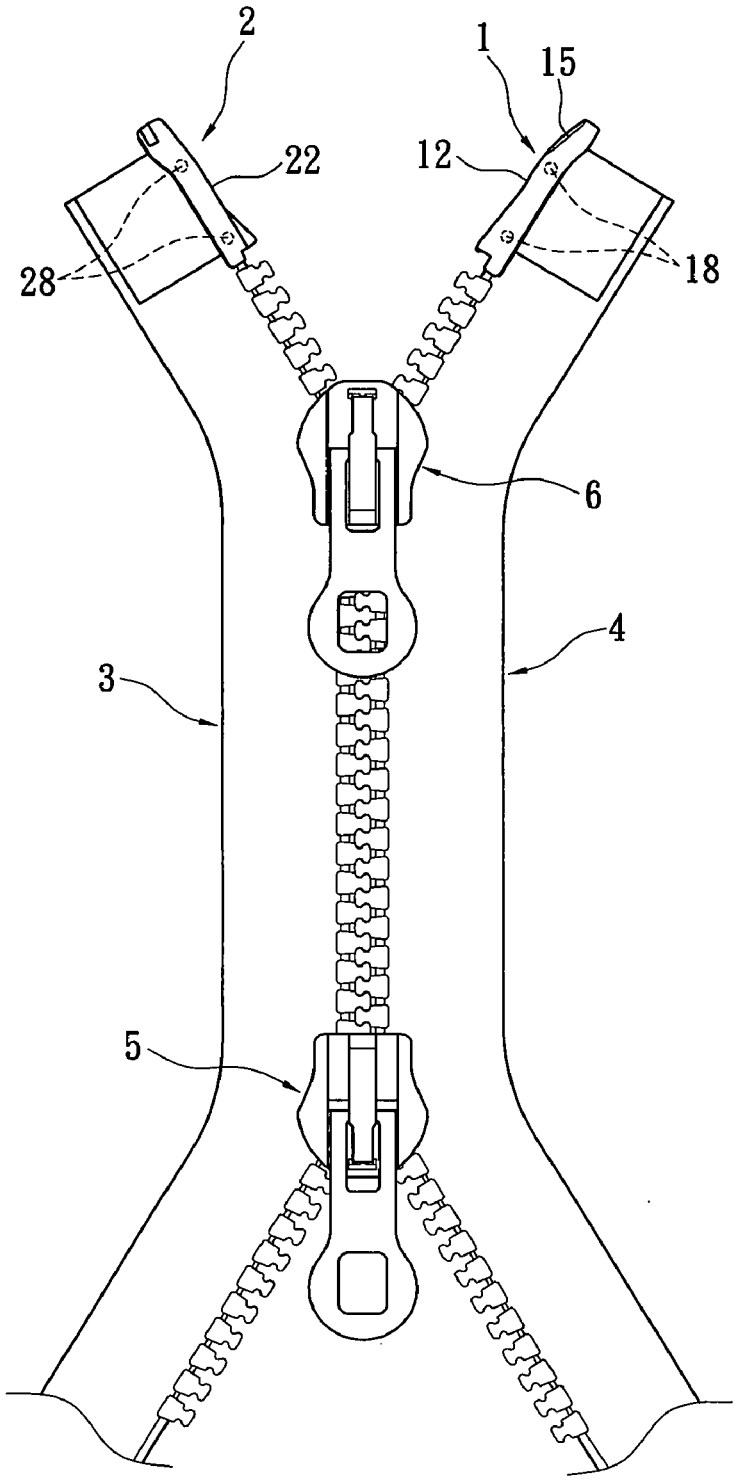
FIG. 10 is a schematic diagram of the plug pin set being assembled on a double open zipper of the present invention.

Reference is made to FIG. 10. The plug pin 1 utilizes the first joint trough 14 so as to join with one end of the second zipper belt 4. The position pin 2 utilizes the second joint trough 24 so as to join with one end of the first zipper belt 3. The plug pin 1 and the position pin 2 are respectively fastened onto the second zipper belt 4 and the first zipper belt 3 by using the punching the fastening points 18, 28. The fastening points 18, 28 are punched and formed on one side or two sides of the plug pin 1 and the position pin 2. In this embodiment, one side of the plug pin 1 has two fastening points 18, and one side of the position pin 2 has two fastening points 28 so that the plug 1 and the position pin 2 are joined with the second zipper belt 4 and the first zipper belt 3. The plug pin 1 corresponds to the position pin 2.

While the fastening points 18, 28 are being punched and formed, the sides that the plug pin 1 and the position pin 2 are connected (the first long side 12, the third long side 22) are then extruded and protruded due to punching. The present invention utilizes the first concave trough 16 and the second concave trough 25 to cancel the extruding and protruding effect so that the sides that the plug pin 1 and the position pin 2 that are connected is kept in a plane and not distorted. Therefore, the sides that the plug pin 1 and the position pin 2 are connected do not become protruded to cause interference with the movement of the first zipper head 5 and the second zipper head. The plug pin 1 and the position pin 2 can therfore be plugged and lifted smoothly.

The plug pin 1 located at one end of the second zipper belt 4 can be plugged into the sliding trough in the second zipper head 6 via the sliding trough in the first zipper head 5 so that the first zipper head 5 and the second zipper head 6 are assembled on the first zipper belt 3 and the second zipper belt 4. The first zipper belt 3 and the second zipper belt 4 that can be toothed together may be controlled to open or close by pulling the first zipper head 5 and the second zipper head 6 forth and back. When the plug pin 1 and the position pin 2 are closed, the convex block 27 is embedded into the embedded trough 17.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. A plug pin of a zipper set having a pair of zipper belts and at least one zipper head, comprising:

a plug pin body for inserting into the zipper head, wherein the plug pin body has an upper long surface, a lower long surface and two lateral surfaces respectively joining the upper and the lower long surfaces wherein the plug pin body has a first joint trough arranged on the lower long surface for adapting to one end of the zipper belt, wherein the plug pin body has a first concave trough arranged only on the upper long surface, wherein the plug pin body is fixed to one end of the zipper belt through punching on at least one of the lateral surfaces thereof, wherein the first concave trough provides a buffering space for compensating for the distortion effect due to the punching process, thereby avoiding interference caused by the protruding material of the punched plug pin body.

2. The plug pin of a zipper set as claimed in claim 1, wherein the first concave trough is located at the center of the plug pin body.

3. The plug pin of a zipper set as claimed in claim 1, wherein the plug pin is a metal piece.

4. The plug pin of a zipper set as claimed in claim 1, wherein the first joint trough passes through the lower long surface and the rear side of the plug pin body.

5. A position pin of a zipper set having a pair of zipper belts and at least one zipper head, comprising:

a position pin body for retaining the zipper head on the zipper belt, wherein the position pin body has an upper long surface a lower long surface, and two lateral surfaces respectively joining the upper and lower long surfaces, wherein the position pin body has a second joint trough arranged on the lower long surface for adapting to one end of the zipper belt, wherein the position pin body has a second concave trough arranged only on the upper long surface, wherein the position pin body is fixed to the zipper belt through punching on at least one of the lateral surfaces thereof, wherein the second concave trough provides a buffering space for compensating for the distortion effect due to the punching process, thereby avoiding interference caused by the protruding material of the punched position pin body.

6. The position pin of a zipper set as claimed in claim 5, wherein the second concave trough is located at the center of the position pin body.

7. The position pin of a zipper set as claimed in claim 5, wherein the position pin is a metal piece.

8. The position pin set of a zipper as claimed in claim 5, wherein the second joint trough passes through the lower long surface and the rear side of the position pin body.

9. A zipper set having a pair of zipper belts and at least one zipper head, comprising:

a plug pin having a plug pin body for inserting into the zipper head, wherein the plug pin body has an upper long surface a lower long surface, and two lateral surfaces respectively joining the upper and the lower long surfaces thereof, wherein the plug pin body has a first joint trough arranged on the lower long surface thereof for adapting to one end of the zipper belt, wherein the plug pin body has a first concave trough arranged only on the upper long surface thereof; and a position pin having a position pin body for retaining the zipper head on the zipper belt, wherein the position pin body has an upper long surface a lower long surface, and two lateral surfaces respectively joining the upper and the lower long surfaces thereof, wherein the position pin body has a second joint trough arranged on the lower long surface thereof for adapting to one end of the zipper belt, wherein the position pin body has a second concave trough arranged only on the upper long surface thereof, wherein the plug pin body and the position pin body are respectively fixed on one end of each zipper belt through punching on at least one of the respective lateral surfaces thereof, wherein the first and the second concave troughs respectively provide buffering spaces for compensating for the distortion effect due to the punching process, thereby avoiding interference caused by the protruding material of the punched plug pin and the position pin bodies.

10. The zipper set as claimed in claim 9, wherein the first concave trough is located at the center of the plug pin body, and the second concave trough is located at the center of the position pin body.

11. The zipper set as claimed in claim 9, wherein the plug pin and the position pin are metal pieces.

12. The zipper set as claimed in claim 9, wherein the first joint trough passes through the lower long surface and the rear side of the plug pin body, and the second joint trough passes through the lower long surface and the rear side of the position pin body.

13. The zipper set as claimed in claim 9, wherein another two opposite sides of the position pin body respectively has a blocking point, and the two blocking points are adjacent to the front side of the plug pin body.

14. The zipper set as claimed in claim 9, wherein the upper long surface of the plug pin has an embedded trough, the embedded trough is adjacent to the rear side of the plug pin body, and wherein the upper long surface of the position pin has a convex block, the convex block is adjacent to the rear side of the position pin body, and the convex block corresponds to the embedded trough.

* * * * *